US005515411A

United States Patent [19]

Tonami et al.

[11] Patent Number: 5,515,411

[45] Date of Patent: May 7, 1996

[54] X-RAY IMAGE PICKUP TUBE

[75] Inventors: Hiromichi Tonami, Kyoto; Takahisa Nishikawa, Nagaokakyou; Takayuki Takemoto; Yutaro Kimura, both of Kyoto; Keiichi Hiragaki, Takatsuki; Hidetoshi Kishimoto, Kyoto; Tatsuya Shimizu, Kyoto; Shiro Oikawa, Shiga; Tutomu Katou, Hatano; Shirou Suzuki, Yokosuka; Toshio Yamagishi, Kawasaki; Kenkichi Tanioka, Tama, all of Japan

[73] Assignees: Shimadzu Corporation, Kyoto; Nippon Hoso Kyokai, Tokyo, both of Japan

[21] Appl. No.: 215,950

[22] Filed: Mar. 22, 1994

[30] Foreign Application Priority Data

Mar. 31, 1993 [JP] Japan ..... 5-098634
Aug. 27, 1993 [JP] Japan ..... 5-213186

[51] Int. Cl.[6] ..... H01J 40/14

[52] U.S. Cl. ..... 378/98.8; 378/19; 250/214 VT

[58] Field of Search ..... 250/214 VT, 208.1, 250/216; 378/176, 189, 190, 98.2, 98.3, 98.8, 19

[56] References Cited

U.S. PATENT DOCUMENTS 4,935,617 6/1990 Anno et al. ..... 250/214 VT
5,117,114 5/1992 Street et al. ..... 250/370.11
5,195,118 3/1993 Nudelmann et al. ..... 378/98.2
5,302,423 4/1994 Tran et al. ..... 427/555
5,306,907 4/1994 Nudelmann et al. ..... 250/214 VT
5,368,882 11/1994 Tran et al. ..... 427/65

*Primary Examiner*—David P. Porta
*Assistant Examiner*—Don Wong
*Attorney, Agent, or Firm*—Nikaido, Marmelstein, Murray & Oram

[57] ABSTRACT

An X-ray image pickup tube converts a transmitted X-ray image into electric signals. The pickup tube includes a target structure having a fluorescent element, and a translucent conductive film for receiving a high voltage, with a photoconductive film laminated thereupon. The fluorescent element receives transmitted X rays in a two-dimensional distribution, and converts them into visible rays in a two-dimensional distribution. The translucnet conductive film is optically coupled to a surface of the fluorescent element opposite from an X-ray incident surface thereof. The photoconductive film includes an amorphors semiconductor layer which converts the visible rays transmitted in a two-dimensional distribution through the translucent conductive film, into electric charges in a two-dimensional distribution, and which multiplies the electric charges in the two-dimensional distribution based on electric fields formed by the high voltage applied to the translucent conductive film. The pickup tube also has a signal reading device in the form of an electron gun or switching elements for scanning a surface of the photoconductive film, as electric signals, a two-dimensional electric potential distribution occurring on the photoconductive film.

10 Claims, 6 Drawing Sheets

X-RAY IMAGE PICKUP TUBE

BACKGROUND OF THE INVENTION

1. Field of the Invention

This invention relates to an X-ray image pickup tube for converting X-ray images into electric signals in an X-ray television system for use in medical diagnosis or non-destructive inspection of materials.

2. Description of the Related Art

In a conventional X-ray television system, an X-ray image intensifier and a television image pickup tube are combined to convert X-ray images into electric signals. That is, X rays enter the image intensifier where the incident X rays are converted into visible rays by a converting film such as of CsI. Thereafter electrons are released from a photoconductive film and, while being multiplied, passed to an output fluorescent film to be converted into visible light. Then, a visible light image is outputted from this output fluorescent film. The pickup tube is optically coupled to an output plane of the image intensifier. The visible light image is projected through an optical lens or the like to an image pickup plane of the image pickup tube. Consequently, electric charges corresponding to the incident light accumulate on the pickup plane, which are scanned and read by an electron beam to output electric signals.

Also known is an X-ray television system employing an X-ray image pickup tube such as an X-ray HARP (High-gain Avalanche Rushing amorphous Photoconductor) tube to convert X rays directly into electrons. This X-ray image pickup tube includes an X ray to electricity conversion film formed of a material such as amorphous selenium which is sensitive to X-ray regions, and which is the photoconductive conversion film used in the ordinary visible light image pickup tube. That is, this X-ray image pickup tube does not use the X ray to visible light conversion film such as of CsI used in the image intensifier, but instead uses an amorphous selenium film for converting X rays directly into electric charges, thereby to obtain electric signals amplified by an avalanche effect.

However, with the conventional X-ray television system combining the X-ray image intensifier and television image pickup tube, an X-ray image is converted into final electric image signals through numerous conversion steps as noted above; converting X rays to visible rays, then to electrons, to visible rays again which are passed through optics, to visible rays yet again, and to electric signals. Such a process tends to provide a poor efficiency of conversion, and inevitably causes a final image to have a low signal to noise (S/N) ratio. In addition, the combination of the image intensifier and image pickup tube has a drawback of complicating and enlarging the apparatus. With the X-ray image pickup tube such as an X-ray HARP tube having an amorphous selenium film for converting X rays directly into electric charges, the amorphous selenium film, which has a high X-ray transmittance, must be formed as thick as 500 μm or thereabout in order to increase the efficiency of conversion. This is hardly practicable since an extra-high voltage is required to bring about the avalanche effect. Moreover, it is difficult from the manufacturing point of view to form the amorphous selenium film thick and uniform over a wide range. It is thus difficult to provide this type of X-ray image pickup tube with a large aperture.

SUMMARY OF THE INVENTION

This invention has been made having regard to the state of the art noted above, and its primary object is to provide an X-ray image pickup tube, which allows X rays to be converted into electric signals efficiently, obtains image signals of high luminance and contrast even from a low dose of X rays, and may easily be formed to have a large aperture.

The above object is fulfilled, according to this invention, by an X-ray image pickup tube for converting a transmitted X-ray image into electric signals, comprising:

a fluorescent element for receiving transmitted X rays in a two-dimensional distribution and converting the transmitted X rays into visible rays in a two-dimensional distribution;

a translucent conductive film optically coupled to a surface of the fluorescent element opposite from an X-ray incident surface thereof, the translucent conductive film receiving a high voltage;

a photoconductive film laminated on the translucent conductive film and including an amorphous semi-conductor layer having functions to convert the visible rays transmitted in a two-dimensional distribution through the translucent conductive film, into electric charges in a two-dimensional distribution, and to multiply the electric charges in the two-dimensional distribution based on electric fields formed by the high voltage applied to the translucent conductive film; and a signal reading device for scanning a surface of the photoconductive film opposite from a visible ray incident surface thereof to read, as electric signals, a two-dimensional electric potential distribution occurring on the photoconductive film.

This invention has the following functions.

The fluorescent element converts transmitted X rays in a two-dimensional distribution into visible rays in a two-dimensional distribution. The visible rays travel to the photoconductive film through the translucent conductive film optically coupled to the fluorescent element. The photoconductive film converts the incident visible rays in the two-dimensional distribution into electric charges in a two-dimensional distribution. At the same time, the electric charges in the two-dimensional distribution are multiplied by the charge multiplying function of the amorphous semiconductor layer based on electric fields formed by the high voltage applied to the translucent conductive film. As a result, a two-dimensional distribution of electric potentials corresponding an intensity distribution of the incident X rays occurs on the photoconductive film. The signal reading device scans the photoconductive film to read the two-dimensional distribution of electric potentials as electric signals.

According to this invention, the photoconductive film including the amorphous semiconductor layer multiplies the electric charges in a two-dimensional distribution. Consequently, X-ray image signals of high luminance and contrast are obtained even from a low dose of incident X rays. Compared with a combination of an image intensifier and an image pickup tube, the image pickup tube according to this invention obtains X-ray image signals through few convertion steps, thereby diminishing noise mixing to realize high quality images. The invention provides a simpler and smaller construction than the combination of an image intensifier and an image pickup tube. Further, since the amorphous semiconductor layer included in the photoconductive film receives visible rays instead of X rays, the amorphous semiconductor layer may be formed thinner than in the conventional X-ray HARP tube. Thus, the amorphous semiconductor layer may easily be formed uniform over a wind range, to enable this type of X-ray image pickup tube to have an enlarged aperture.

The amorphous semiconductor layer included in the photoconductive film is not limited to any particular type as long as the semiconductor layer performs an electric charge multiplying function. However, a preferred amorphous semiconductor layer used in this invention has selenium (Se) as a main component thereof. When strong electric fields are applied to the amorphous semiconductor layer having selenium as a main component, an electric charge multiplying function occurs within the amorphous semiconductor layer. This is considered due to an avalanche effect produced in the interior of the amorphous semiconductor layer having selenium as a main component thereof.

Preferably, the amorphous semiconductor layer has blocking layers formed on opposite surfaces thereof, respectively, for blocking entry of electric charges to the amorphous semiconductor layer, in order to reduce dark current.

The fluorescent element is not limited to any particular type as long as this element converts X rays into visible rays. However, a preferred fluorescent element used in this invention has a needle crystal structure of cesium iodide (CsI:Na) doped with sodium (Na), which has a high X-ray converting efficiency.

Where the translucent conductive film is formed directly on the needle crystal structure of CsI:Na, with the photoconductive film laminated thereon, the amorphous semiconductor layer of the photoconductive film has an uneven thickness because of the corrugated surface of the needle crystal structure of CsI:Na. As a result, strong electric fields tend to concentrate locally within the amorphous semiconductor layer to cause sparks or the like, which may destroy such portions of the layer. It is thus desirable to smooth the surface of the fluorescent element (the needle crystal structure of CsI:Na), with which the translucent conductive film is formed in tight contact.

However, such a smoothing treatment is not limitative as means for avoiding destruction of the amorphous semiconductor layer due to the corrugated surface of the needle crystal structure of CsI:Na. An intermediate layer may be disposed between the fluorescent element and translucent conductive film, the intermediate layer having at least one smooth surface opposed to the translucent conductive film.

Such an intermediate layer may, for example, be a thin glass plate, a fiber plate having a multiplicity of optical fibers bundled together, or a resin layer coated on the fluorescent element. The fiber plate is preferred since light is not scattered as occurs with a glass plate. The fiber plate may be formed relatively thin to act as a supporting base for the target structure (i.e. laminate of the fluorescent element, conductive film and photoconductive film).

The resin layer coating may be used as intermediate layer with the advantage that a smooth-surfaced intermediate layer is formed easily and at low cost.

The signal reading device may be in the form of a single electron gun for two-dimensionally scanning the photoconductive film with an electron beam. Where an electron gun is used, the X-ray image pickup tube tends to be rather long. To construct an X-ray image pickup tube having a reduced length, the signal reading device may comprise a group of switching elements in a two-dimensional arrangement on the photoconductive film. It is also possible to provide an electron beam generating mechanism including a plurality of linear cathodes or conical cathodes acting as electron beam sources.

BRIEF DESCRIPTION OF THE DRAWINGS

For the purpose of illustrating the invention, there are shown in the drawings several forms which are presently preferred, it being understood, however, that the invention is not limited to the precise arrangements and instrumentalities shown.

DETAILED DESCRIPTION OF THE PREFERRED EMBODIMENTS

Preferred embodiments of this invention will be described in detail hereinafter with reference to the drawings.

First Embodiment

Figure 1:
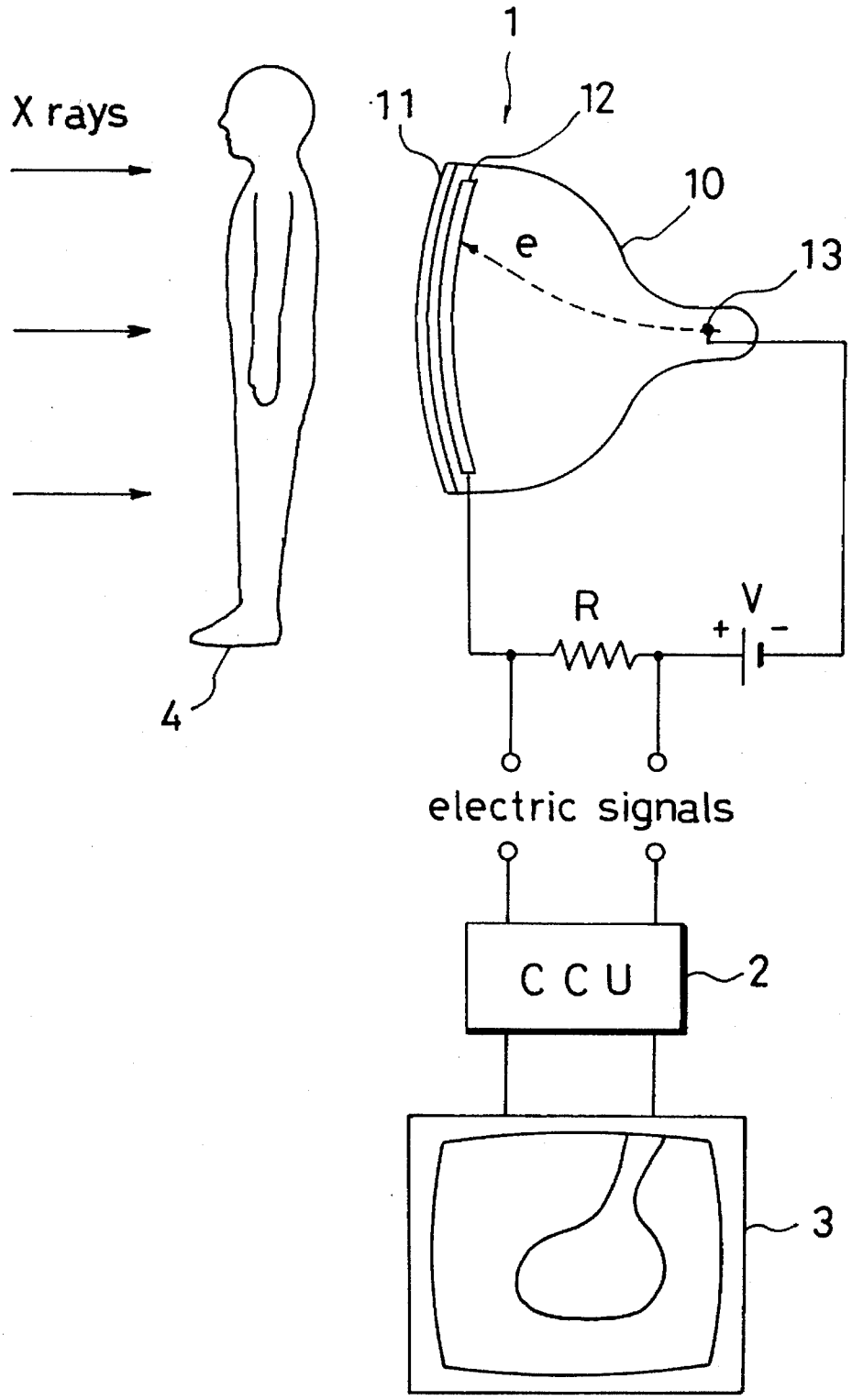
FIG. 1 is a schematic view showing an outline of an X-ray image pickup tube and adjacent devices in a first embodiment of the invention.

As shown in FIG. 1, an X-ray image pickup tube 1 includes a target 12 and an electron gun 13 mounted in a vacuum bulb 10. X rays transmitted through an object 4 travel in a two-dimensional distribution through an X-ray penetrable window 11 to the target 12.

Figure 2:
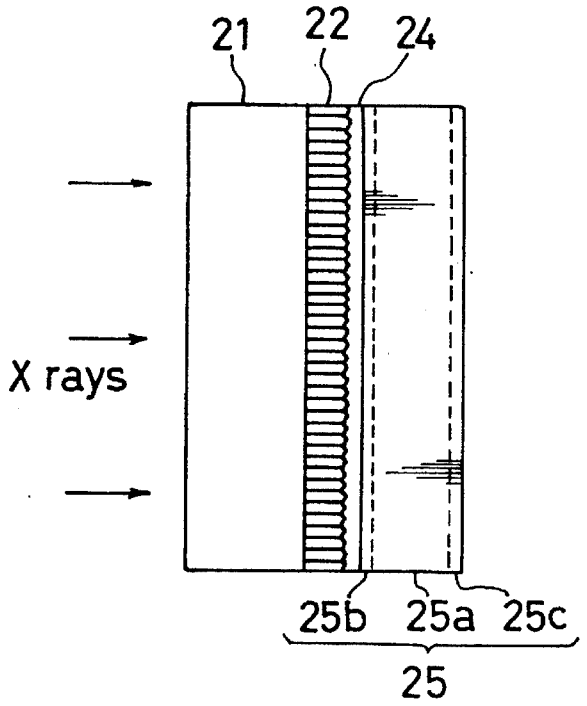
FIG. 2 is a schematic view of a target structure employed in the X-ray image pickup tube in the first embodiment.

As schematically shown in FIG. 2, the target 12 includes a substrate 21, a fluorescent element 22 formed on a non-incident surface of the substrate 21, a conductive film 24 formed on the fluorescent element 22, and a photoconductive film 25 formed in tight contact with the conductive film 24.

The substrate 21 serves to secure a mechanical strength of the target 12, and is formed of an X-ray penetrable material, such as aluminum, metallic beryllium, glass or ceramic, having a thickness of 1 to 2 mm.

The fluorescent element 22 is formed of a material responsive to X rays to produce visible rays, such as CSI:Na, ZnS or $CaWO_4$. In particular, a needle crystal structure of CsI:Na is preferred from the point of view of X-ray converting efficiency. The layer thickness of CsI:Na is normally in the order of 200 to 400 μm.

The conductive film 24 comprises a translucent conductive film such as of ITO or $SnO_2$ which is an alloy of indium, tin and oxygen. The conductive film 24 should be formed as thin as possible (about 300 Å) to prevent scattering of light.

The photoconductive film 25 includes an amorphous semiconductor layer 25*a* having selenium (Se) as a main component thereof, and two blocking layers 25*b* and 25*c* arranged at opposite sides of the amorphous semiconductor layer 25*a*. The amorphous semiconductor layer 25*a* acts as a substantial photoconductive conversion film for converting visible light into electric signals. Since X rays do not directly enter the amorphous semiconductor layer 25*a* as in the known X-ray HARP tube, the amorphous semiconductor layer 25*a* may be relatively thin, i.e. normally in the order of 4 to 20 μm. The blocking layers 25*b* and 25*c* are provided to prevent electric charges from being applied to the amorphous semiconductor layer 25*a*. The blocking layer 25*b* opposed to the conductive film 24 is formed of $CeO_2$, $GeO_2$ or the like. The blocking layer 25*c* at the electron beam receiving side is formed of $Sb_2S_3$ or the like. It is not absolutely necessary to form the amorphous semiconductor layer 25*a* of selium only, but may include impurities such as As, Ge, Te or the like added thereto in order to improve thermal stability or sensitivity.

The above target 12 is manufactured by the following process, for example.

First, the fluorescent element 22 is formed on one surface of the substrate 21 by depositing CsI:Na thereon by vacuum evaporation. At this time, the needle crystal structure of CsI:Na is obtained by maintaining the substrate 21 at 200° to 400° C. The conductive film 24 is formed on the surface of the fluorescent element 22 by depositing ITO thereon by vacuum evaporation or sputtering. Then, the blocking layer 25*b*, amorphous semiconductor layer 25*a* and blocking layer 25*c* are formed on the conductive layer 24 in the stated order by vacuum evaporation. At this time, the substrate 21 is maintained at a temperature not exceeding 60° C. to avoid crystallization of the amorphous semiconductor layer 25*a*.

Operation of the X-ray image pickup tube having the above construction will be described next.

When X rays transmitted through the object 4 travel in a two-dimensional distribution through the X-ray penetrable window 11 and collide with the target 12, X-ray incident portions of the fluorescent element 22 emit visible light which, in a two-dimensional distribution, travels through the translucent conductive film 24 to the photoconductive film 25. As the light reaches the amorphous semiconductor layer 25*a*, electric charges (electron and hole pairs) are generated therein, resulting in high electric potentials of the portions having received the light. Thus, a two-dimensional distribution of electric potentials corresponding to an incident X-ray image is obtained on the photoconductive film 25.

A high voltage is applied between the conductive film (ITO film) 24 of the target 12 and the electron gun 13. As a result, strong electric fields are applied to the amorphous semiconductor layer 25*a*, to produce an avalanche effect on the amorphous semiconductor layer 25*a*. This increases the electric charges exponentially to raise the electric potentials. To produce this avalanche effect, strong electric fields in the order of $10^8$V/m are required. This is achieved relatively easily by forming the amorphous semiconductor layer 25*a* to be thin as noted above. The increase in electric charges raises the electric potentials of the photoconductive film 25 to a great degree. However, portions of the photoconductive film 25 not exposed to the X-ray radiation remain in low potential.

The two-dimensional distribution of electric potentials on the photoconductive film 25 is read by an electron beam. That is, the electron gun 13 emits an electron beam "e" toward the target 12. A current proportional to the potential in a portion struck by the electron beam "e" flows between the target 12 and electron gun 13. Consequently, voltage signals are obtained at opposite ends of a resistor R. The electron beam "e" is deflected by a deflector coil not shown, to scan the target 12 two-dimensionally. As a result, the distribution of electric potentials on the photoconductive film 25 is read as electric image signals.

These electric signals are converted into video signals by a camera control unit (CCU) 2, which are transmitted to a television monitor 3. As a result, an X-ray penetration image of the object 4 is displayed on the screen of the television monitor 3.

With this X-ray image pickup tube 1, X rays are converted into visible rays, and electric charges are generated according to intensity of the visible rays. These electric charges are amplified by the avalanche effect, thereby to obtain strong electric signals even from a low dose of incident X rays. The X-ray image pickup tube 1 requires few steps for converting X rays into electric signals, thereby to produce little noise. Consequently, X-ray penetration images appearing on the screen of the television monitor 3 have high levels of luminance and contrast, with a large S/N ratio. Further, since the amorphous semiconductor layer 25*a* may be formed thin, it is easy to manufacture the photoconductive film 25 having a large area and a uniform material thickness. As a result, the X-ray image pickup tube 1 may have a large aperture with a wide range of view corresponding to the size of a region to be inspected. With the large aperture of the X-ray image pickup tube 1, the electron gun 13 may also be enlarged to provide an increased current for reading purposes, thereby increasing dynamic ranges of signals.

Figure 3:
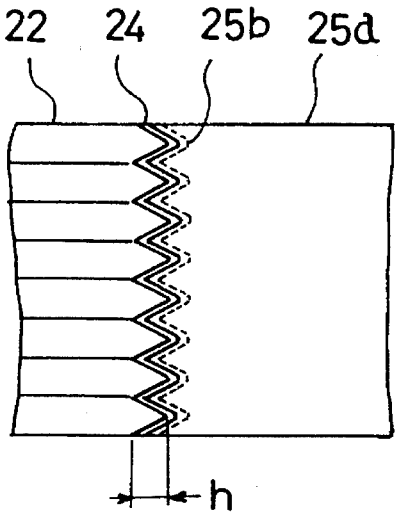
FIG. 3 is an enlarged view of a junction between a fluorescent element surface and a photoconductive film.

The fluorescent element 22 formed on the substrate 21 and comprising a needle crystal structure of CsI:Na defines a corrugated surface having a ridge height "h" in the order of 2 μm as shown in FIG. 3. Because of such corrugation, the photoconductive film 25 coated thereon through the very thin conductive film 24 cannot have a uniform thickness. When a high voltage is applied between the conductive film 24 and electron gun 13, strong electric fields tend to concentrate locally within the amorphous semiconductor layer 25*a* of the photoconductive film 25. As a result, such locations may be subjected to sparks or the like, destroying pixels.

To avoid such an inconvenience, it is desirable to smooth the surface of the fluorescent element 22. Preferably, the ridge height "h" on the surface of the fluorescent element 22 should be 0.1 μm or less. It is to be noted, however, that large, wavy undulations do not produce a local concentration of electric fields in the amorphous semiconductor layer 25*a*. Thus, such level differences, even when exceeding 0.1 μm, are acceptable.

Second Embodiment

This embodiment includes a thin glass plate interposed as a smooth intermediate layer between a fluorescent element 22 and a conductive film 24.

Figure 4:
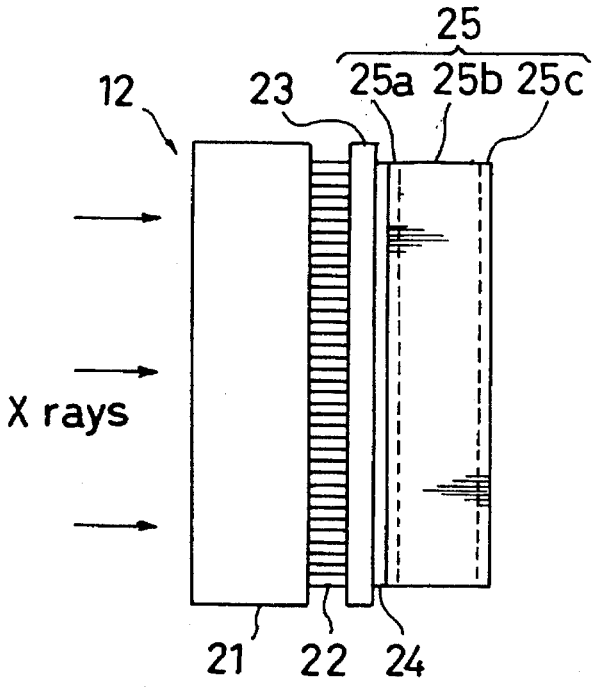
FIG. 4 is a schematic view of a target structure in a second embodiment.

Reference will be made to FIG. 4 showing a schematic view of the second embodiment.

The target 12 in this embodiment includes a substrate 21, a fluorescent element 22 formed on a non-incident surface of the substrate 21, a thin glass plate 23 formed as a smooth intermediate layer on the fluorescent element 22, a translucent conductive film 24 formed on the glass plate 23, and a photoconductive film 25 formed on the conductive film 24.

The substrate 1, fluorescent element 22, conductive film 24 and photoconductive film 25 have the same structures as in the first embodiment and will not be described again.

The thinner the glass plate 23 is, the better for diminishing scattering, in directions parallel to planes thereof, of light emerging from the fluorescent element 22. The glass plate 23 has a thickness of approximately 50 μm, for example. At least the surface of the glass plate 23 opposed to the conductive film 24 is smoothed to allow the photoconductive film 25 to have a uniform thickness. Level differences on this surface of the glass plate 23 are limited to 0.1 μm.

The target 12 having the above structure is manufactured by the following process, for example.

First, the fluorescent element 22 is formed on one surface of the glass plate 23 by depositing CsI:Na thereon by vacuum evaporation. The conductive film 24 is formed on the other surface of the glass plate 23 by depositing ITO thereon by vacuum evaporation or sputtering. The blocking layer **25*b*, amorphous semiconductor layer 25*a* and blocking layer 25*c* are formed on the conductive layer 24 in the stated order by vacuum evaporation. After these layers are formed on the glass plate 23, the surface of the glass plate 23 opposed to the fluorescent element 22 is bonded to the substrate 21** by using an epoxy type adhesive or the like. The adhesive used should be the type to release a minimal quantity of gas in a decompressed atmosphere.

With the X-ray image pickup tube constructed as above, incident X rays cause the fluorescent element 22 to emit light which travels through the thin glass plate 23 and translucent conductive film 24 to the photoconductive film 25. The electric charge multiplying function of the photoconductive film 25 is the same as in the first embodiment, and will not be described here.

According to this embodiment, since the conductive film 24 and photoconductive film 25 are formed on the smoothed surface of the glass plate 23, the amorphous semiconductor layer **25*a* may have a uniform thickness, thereby to avoid a local concentration of electric fields in the amorphous semiconductor layer 25*a***.

Third Embodiment

Figure 5:
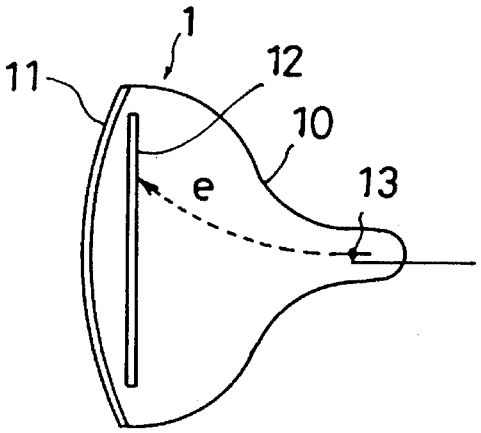
FIG. 5 is a schematic view showing an outline of an X-ray image pickup tube in a third embodiment.
Figure 6:
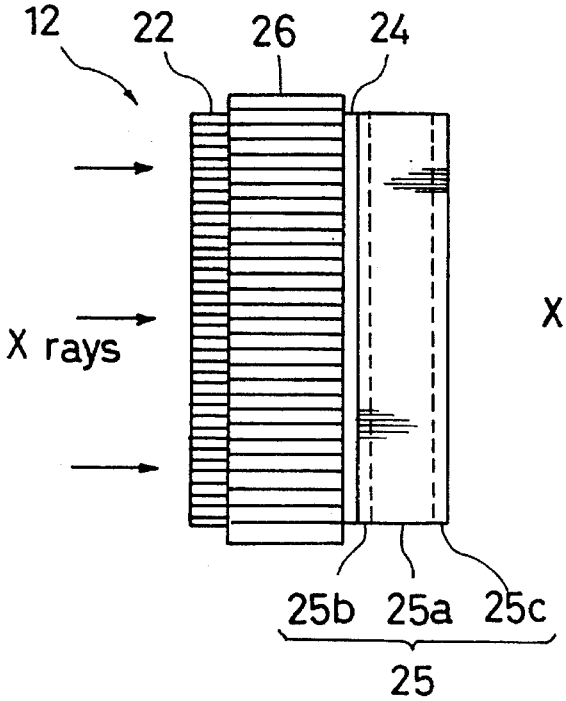
FIG. 6 is a schematic view of a target structure employed in the X-ray image pickup tube in the third embodiment.

FIGS. 5 and 6 show an outline of a third embodiment. As seen, the target 12 in this embodiment includes a fiber plate 26 having smoothed surfaces, a fluorescent element 22 formed by vapor deposition on one surface (X-ray incident side) of the fiber plate 26, and a conductive film 24 and a photoconductive film 25 formed on the other surface of the fiber plate 26. The fiber plate 26 acts as a translucent film and also as a supporting base for the fluorescent element 22, conductive film 24 and photoconductive film 25.

The fiber plate 26 includes a multiplicity of optical fibers of minute diameter in the order of 6 to 25 μm bundled and joined together between peripheral surfaces, which are cut to 1 to 3 mm to form a thin plate. Light is transmitted in a direction of thickness of the fiber plate 26 but not in directions parallel to the surfaces thereof. The fiber plate 26 is free from a drawback of the mere glass plate 23 used in the second embodiment. That is, in the case of the thin glass plate 23, the light from the fluorescent element 22 is transmitted in the direction of thickness as well as directions parallel to the surfaces of the glass plate 23, thereby to lower resolution. This may be avoided by minimizing the thickness of the glass plate 23. However, the glass plate 23 will be fragile and difficult to handle. With the fiber plate 26, light will not scatter in directions parallel to the surfaces thereof. Consequently, there arises no problem in forming the fiber plate 26 thick for increased strength.

With its strength, the fiber plate 26 is available as the supporting base. Consequently, the substrate 21 as shown in FIG. 4 is dispensed with to provide also the advantage of avoiding attenuation of X rays. It is of course possible to use both the substrate 21 and fiber plate 26.

Figure 7:
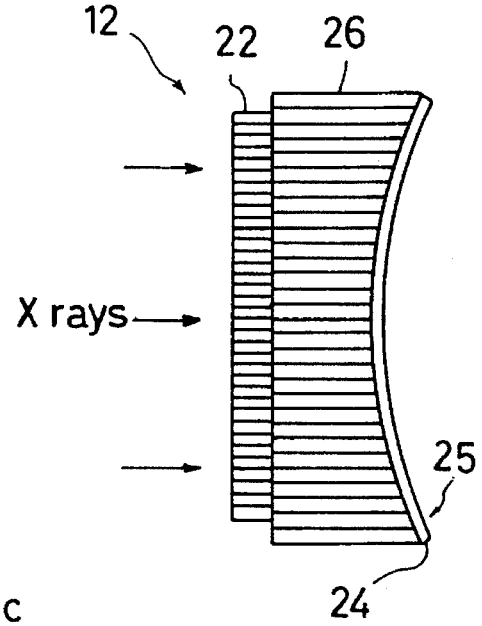
FIG. 7 is a schematic view of a modified target structure in the third embodiment.

In the first and second embodiments, the substrate 21 formed of aluminum or the like may be shaped to present a spherical curve, with the target 12, as shown in FIG. 1, receiving the electron beam to collide with the photoconductive film 25 in directions substantially perpendicular thereto. However, the fiber plate 26 in the third embodiment, because of its structure, is difficult to shape to a curved configuration. FIG. 7 shows a modified fiber plate 26a shaped to have a concave surface opposed to a conductive film 24. Then, the electron beam may be directed to collide with a photoconductive film 25 formed on the concave surface in directions substantially perpendicular thereto.

Fourth Embodiment

Figure 8:
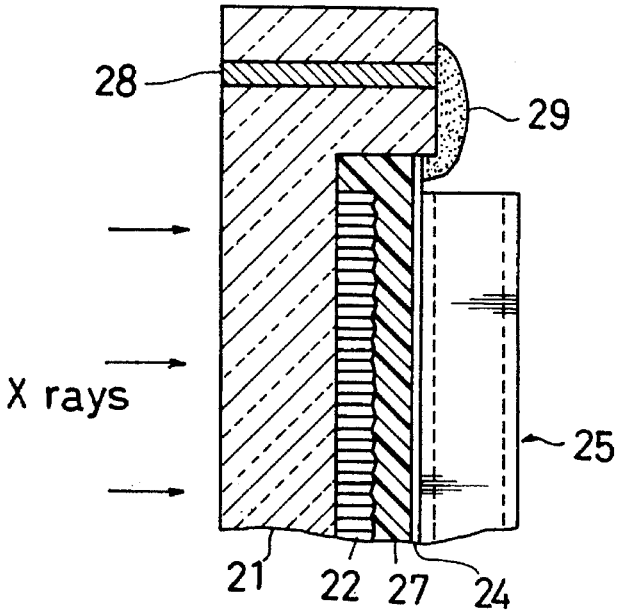
FIG. 8 is a schematic view of a target structure in a fourth embodiment.

FIG. 8 is a schematic view showing a target structure of an X-ray image pickup tube in a fourth embodiment.

In this embodiment, a fluorescent element 22 is formed on one surface of a glass substrate 21. A smoothed resin layer 27 such as of polyimide resin, epoxy resin or the like is interposed between the fluorescent element 22 and a conductive film 24. A photoconductive film 25 is formed on the conductive film 24. The resin layer 27 is formed by what is known as a spin coating method in which liquid polyimide resin or the like is dripped on the substrate 21 spinning at high speed, with the surface on which the fluorescent element 22 is formed facing upward. The resulting resin film is hardened by a subsequent heat treatment. According to this method, it is easy to smooth the surface of the resin layer 27, and to form the resin layer 27 thin. The conductive film 24 is electrically connected at one end thereof to a metal terminal 28 of electric wiring embedded in the substrate 21, through a conductive epoxy resin 29.

The above resin layer 27 may be replaced with an SiO or $SiO_2$ film coated on the fluorescent element 22 by plasma CVD (Chemical Vapor Deposition) or by sputtering.

Fifth Embodiment

In each of the foregoing embodiments, an electric potential distribution on the photoconductive film 25 is read by scanning action of the electron beam emitted from the single electron gun 13. This inevitably requires the X-ray image pickup tube to be elongated in a direction along an electron beam path. In this embodiment, in order to allow the X-ray image pickup tube to have a reduced length, switching elements are used in place of the electron gun to read the electric potential distribution on the photoconductive film 25. The target structure in any of the first to fourth embodiments may be used.

Figure 9:
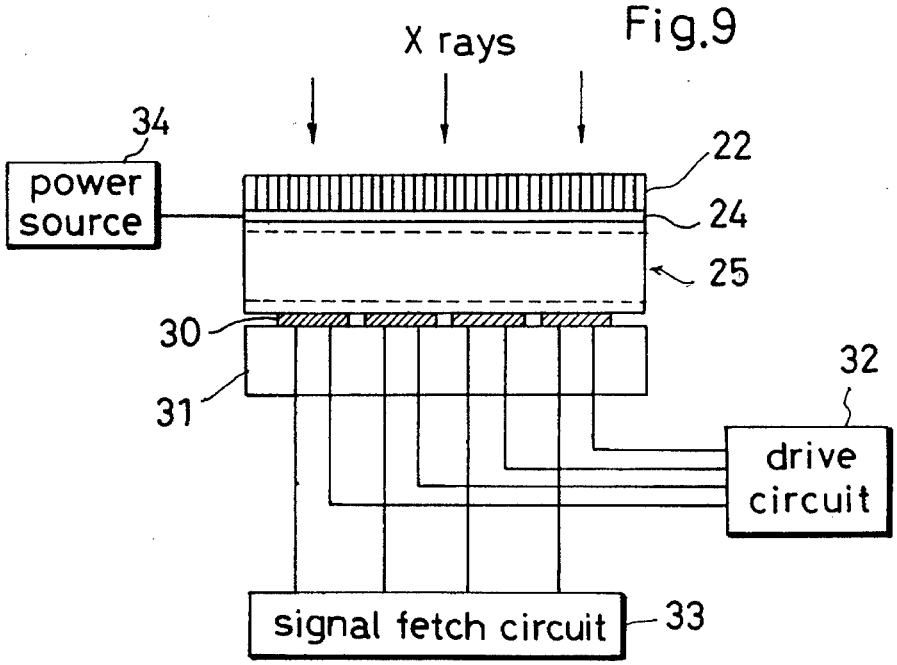
FIG. 9 is a schematic view showing an outline of an X-ray image pickup tube and adjacent devices in a fifth embodiment.

FIG. 9 shows an outline of this embodiment.

The target structure is similar to that of the first embodiment shown in FIG. 2. Thus, a fluorescent element 22, a conductive film 24 and a photoconductive film 25 are laminated in the stated order. Switching elements 30 are arranged two-dimensionally opposite the blocking layer **25*b* of the photoconductive film 25. The number of switching elements 30 is roughly from several hundred by several hundred to several thousand by several thousand, though this is determined according to the resolving power required of the X-ray image pickup tube. The switching elements 30 are formed on an insulating substrate 31. This insulating substrate 31 acts as a target supporting base, and hence the substrate 21 shown in FIG. 2 is not used in this embodiment. However, the substrate 21** may also be used herein.

The switching elements 30 are formed of what is known as thin film transistors (TFT) or thin film diodes (TFD). The former are transistors each including a silicon semiconductor layer, an insulating layer and electrodes. The latter, generally, include amorphous silicon diodes, and MIM diodes each having a tantalum electrode, a tantalic oxide and a chromium electrode connected in series.

The switching elements 30 arranged in matrix form are driven successively by a drive circuit 32. Currents flowing to reset potentials occurring on the photoconductive film 25 to an initial potential are read on a pixel basis by a signal fetch circuit 33. A power source 34 is connected to the conductive film 24 for applying a high voltage to the photoconductive film 25.

An example where silicon semiconductor TFTs are used as the switching elements 30 will be described with reference to FIG. 9.

First, semiconductor elements are formed in a matrix pattern on a sufficiently smoothed surface of the insulating substrate 31 by a vapor phase growth method such as plasma CVD, by sputtering, or by using a photolithographic technique, and electrodes are formed for the respective elements. The insulating substrate 31 preferably comprises a glass substrate. To avoid a deterioration in the characteristics of the TFTs, what is known as alkali-free glass containing very little sodium is most suitable.

Further, a preferred degree of smoothness is such that the curvature in a range of several centimeters does not exceed 200 μm, and the undulation in a range of about 1 mm does not exceed several nanometers. The semiconductor elements may comprise amorphous silicon or polycrystalline silicon.

Where amorphous silicon is used, the elements may be formed at low temperature, which provides an advantage of economy in that low-cost glass may be used. Polycrystalline silicon allows a greater carrier mobility within the TFT elements than amorphous silicon. Thus, polycrystalline silicon is preferred from the viewpoint of device characteristics.

The photoconductive film 25 and conductive film 24 are formed on the semiconductor elements by vapor deposition or sputtering. Further, the fluorescent element 22 is formed on the conductive film 24 by vapor deposition.

Since this embodiment does not depend on an electron beam for reading an electric potential distribution on the photoconductive film 25, the target need not be contained in a vacuum bulb as in the preceding embodiments. However, where the fluorescent element 22 comprises CsI:Na, the entire target structure including the switching elements 30 should preferably be sealed or placed in a vacuum container in order to avoid a deterioration in light emitting characteristics due to moisture absorption.

Figure 10:
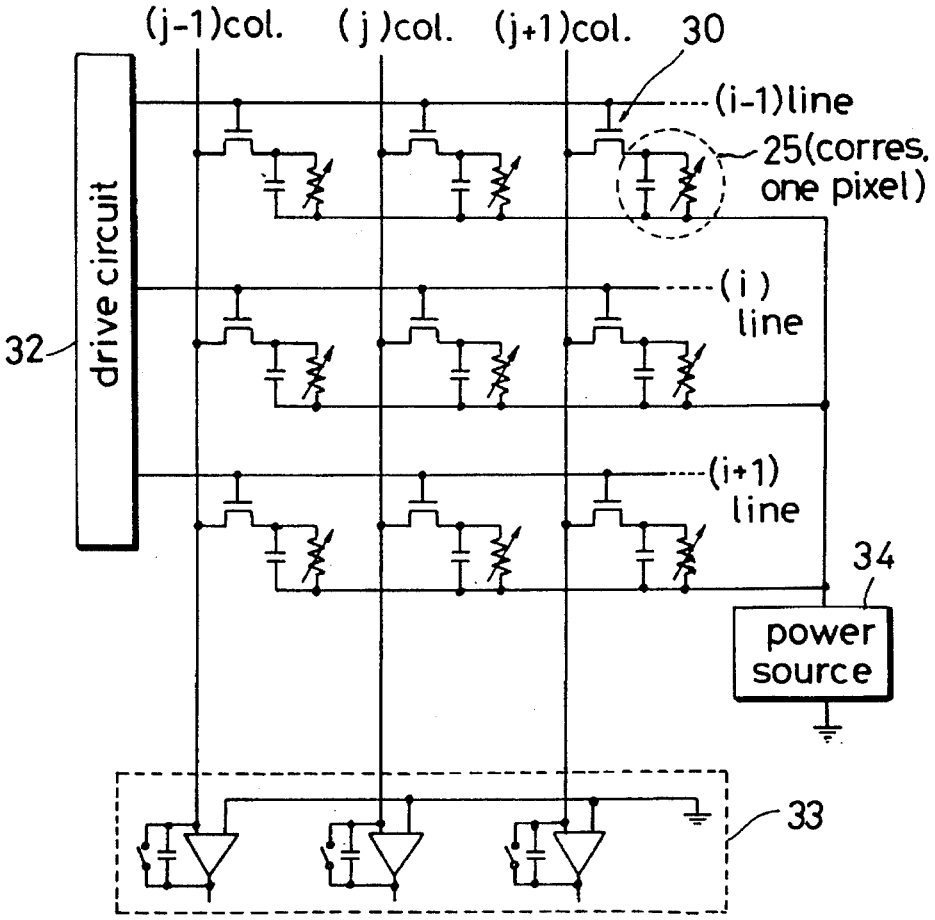
FIG. 10 is a view showing an equivalent circuit of a target portion of the fifth embodiment.

Reading of potentials occurring on the photoconductive film 25 will be described next with reference to the electrically equivalent circuit shown in FIG. 10.

The photoconductive film 25 structurally provides a detecting portion which, as a whole, is an integral film, but electrically includes pixels represented, respectively, by parallel circuits each having a capacitor and a resistor. The integrated photoconductive film 25 is maintained in the same potential by the power source 34.

The fluorescent element 22 emits light upon entry thereto of X rays, and the light is led to the photoconductive film 25 through the translucent conductive film 24. When the light enters each pixel of the photoconductive film 25, the potential stored in the capacitor varies according to the quantity of incident light.

Assuming that the drive circuit 32 selects line [i], the TFT elements on line [i] are turned on to allow currents to flow for recharging the respective pixels, thereby resetting the pixels to the initial potential. The quantities of such currents are read as signals by the signal fetch circuit 33 for respective columns [j−1, j, j+1, . . . ].

Signals outputted from the signal fetch circuit 33 may be transmitted through a sample hold circuit (not shown), a multiplexer (not shown) and an analog-to-digital converter (not shown) to be recorded as digital image signals. A suitable timing circuit (not shown) may be incorporated into the system to use such signals as analog image signals such as television signals.

An example where amorphous silicon semiconductor elements are used as the switching elements 30 will be described next. The target structure is the same as in FIG. 9.

First, amorphous silicon is deposited on a sufficiently smoothed surface of the glass substrate by a vapor phase growth method. Then, diode elements are formed in a matrix pattern by using a photolithographic technique. Each diode element includes a driving electrode and a signal reading electrode, and such electrodes are arranged in the matrix pattern. Then, the photoconductive film 25, conductive film 24 and fluorescent element 22 are formed in the stated order on the diode elements.

The diode elements on a line selected by the driver circuit are turned on. Signals corresponding to potentials occurring on the photoconductive film 25 are then read from the respective pixels by the signal fetch circuit.

A further example where MIM elements are used as the switching elements 30 will be described next.

Tantalic metal is deposited on a sufficiently smoothed surface of the glass substrate by sputtering. Thereafter, unwanted portions are removed by using a photolithographic technique.

Next, the surface of the tantalic metal is oxidized by anodic oxidation to form tantalic oxide. Further, chromium metal is deposited by sputtering, and unwanted portions removed, as in the case of tantalic metal.

After MIM diodes are formed by the above process, the photoconductive film 25 and conductive film 24 are formed on these elements, followed by formation of the fluorescent element 22.

The MIM elements on a line selected by the driver circuit are turned on. Signals corresponding to potentials occurring on the photoconductive film 25 are then read from the respective pixels by the signal fetch circuit.

This example is economical since the elements are formed through a small number of steps.

An example where a thin glass plate is interposed between a fluorescent element and a conductive film will be described next with reference to FIG. 11.

A fluorescent element 22 is formed on a thin, smooth glass plate 23. Apart from this, switching elements 30, a photoconductive film 25 and a conductive film 24 are formed on a glass substrate 31. The two parts are joined by an optical adhesive 35. Though not shown, a poyimide layer may advantageously be formed on the conductive film 24 to smooth joining planes and to protect the elements.

Where, for example, the fluorescent element 22 is formed of CsI:Na which is known to have a crystalline structure greatly variable with temperatures of the surface for deposition (i.e. substrate temperature), a suitable substrate temperature range is 200° to 400° C.

According to this method using the thin glass plate 23, the steps of forming the photoconductive film 25, switching elements 30 and the like may be carried out separately from the step of forming the fluorescent element 22. Consequently, the fluorescent element 22 may be formed without taking account of a deterioration due to heat in the characteristics of the photoconductive film 25 and switching elements 30. This enables a temperature control best suited for vapor deposition of CsI:Na.

It is also unnecessary to consider a temperature increase on the surface for deposition where the vapor deposition progresses at a high rate. Thus, CsI:Na may be deposited in a short time, and the fluorescent element 22 formed in an optimal condition, without entailing a deterioration due to heat of the photoconductive film 25 and the like.

Figure 11:
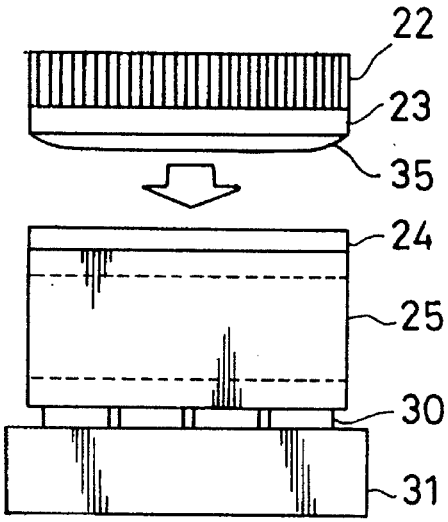
FIG. 11 is a schematic view of a modified target structure in the fifth embodiment.

In the example shown in FIG. 11, the glass plate 23 may be replaced with a fiber plate as described in the third embodiment.

Figure 12:
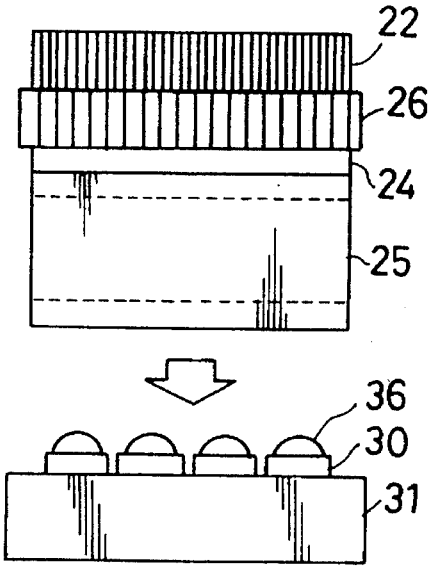
FIG. 12 is a schematic view of another modified target structure in the fifth embodiment.

FIG. 12 shows an example of using a fiber plate.

A conductive film 24 and a photoconductive film 25 are formed by sputtering and vapor deposition, respectively, on one surface of an optically polished fiber plate 26. A fluorescent element 22 is formed on the other surface of the fiber plate 26. Each of these components is a single film not divided for the respective pixels. Thus, the films may be formed relatively easily without requiring a high precision positioning technique such as photolithography.

On the other hand, switching elements 30 are formed in a matrix pattern on a glass substrate 31. A conductive adhesive 36 is used to join the switching elements 30 with the photoconductive film 25 formed on the fiber plate 26.

The conductive adhesive may include commercially available silver as a main component thereof. It is also possible to join the switching elements 30 and photoconductive film 25 at a low temperature by means of hemispherical solder bumps provided for respective pixels, or to join these components by using a mercury type compound.

In this example, the fluorescent element 22 and photoconductive film 25 are formed on the same fiber plate 26. First, the fluorescent element 22 may be formed on one surface of the fiber plate 26 while the latter is heated. Thereafter the photoconductive film 25 may be formed on the other surface of the fiber plate 26. This is effective to avoid a deterioration due to heat in the characteristics of the photoconductive film 25 when the fluorescent element 22 is formed.

Figure 13:
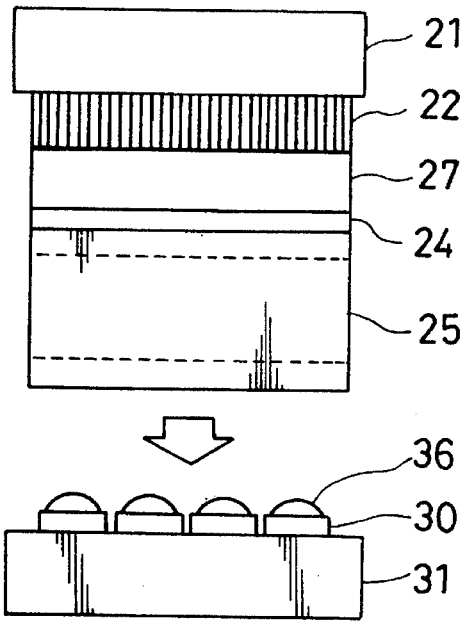
FIG. 13 is a schematic view of a further modified target structure in the fifth embodiment.

FIG. 13 shows a further modification of the fifth embodiment.

In this example, a fluorescent element 22, a resin layer (or SiO or $SiO_2$ layer) 27, a conductive film 24 and a photoconductive film 25 are formed in the stated order on an aluminum or glass substrate 21. On the other hand, as in the example shown in FIG. 12, switching elements 30 are formed in a matrix pattern on a different glass substrate 31. The switching elements 30 are joined by means of a conductive adhesive 36 with the photoconductive film 25 formed on the substrate 21.

Sixth Embodiment

In this embodiment, electron beams are derived from a plurality of linear cathodes, and controlled by an electron beam control device to scan a target and read an electric potential distribution on a photoconductive film. This construction achieves a thin X-ray image pickup tube.

Figure 14:
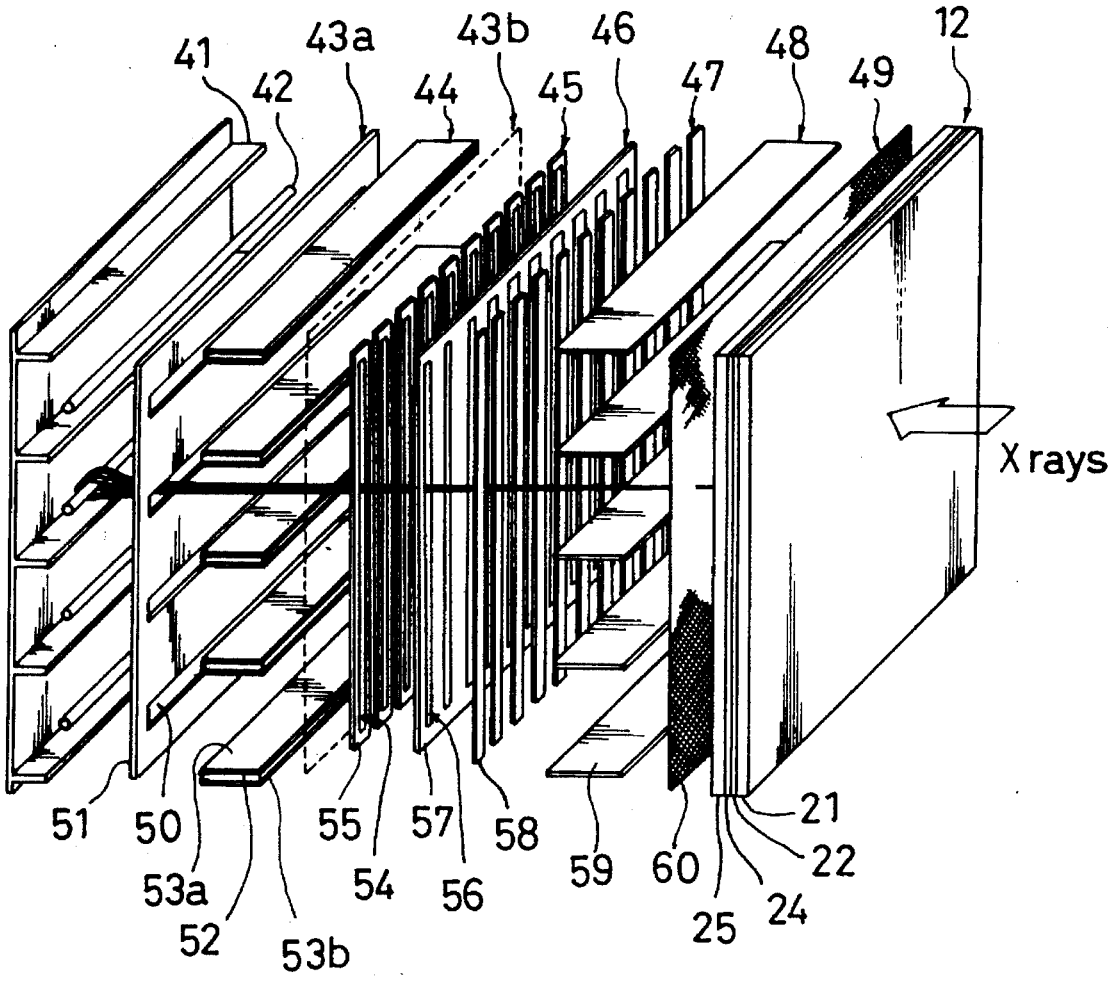
FIG. 14 is a schematic view showing an outline of an X-ray image pickup tube in a sixth embodiment.

The X-ray image pickup tube in this embodiment will be described with reference to FIG. 14.

This embodiment employs the target 12 described in the first embodiment. Thus, the substrate 21, fluorescent element 22, conductive film 24 and photoconductive film 25 are arranged in the stated order from the X-ray incident side. Alternatively, the target structure may comprise one of those described in the second embodiment (FIG. 4), the third embodiment (FIG. 6) and the fourth embodiment (FIG. 8).

An electron beam generating mechanism is opposed to the photoconductive film 25 of the target 12 for reading an electric potential distribution on the photoconductive film 25. This mechanism includes, as arranged successively from left to right in FIG. 14, backing electrodes 41, linear cathodes 42 acting as electron beam sources, vertically converging electrodes **43*a* and 43*b*, vertically deflecting electrodes 44, electron beam flow control electrodes 45, a horizontally converging electrode 46, horizontally deflecting electrodes 47, electron beam accelerating electrodes 48 and a decelerating electrode 49. The target 12** and the electron beam generating mechanism are enclosed in a flat vacuum glass bulb.

Each of the linear cathodes 42 acting as electron beam sources is supported to extend horizontally to generate an electron beam having a horizontal linear expanse. A plurality of such linear cathodes 42 are arranged vertically at suitable intervals. This embodiment includes 63 linear cathodes 42 (though, for expediency, only four are shown in FIG. 14). These linear cathodes 42 are formed, for example, by coating surfaces of tungsten lines of 10 to 29 μm diameter with an oxide cathode material. As described later, the linear cathodes 42 are controlled, successively from top to bottom, to emit electron beams each for a fixed time. The linear cathodes 42 may be replaced with a plurality of conical electrodes in a two-dimensional arrangement.

The backing electrodes 41 have functions to produce potential gradients with the vertically converging electrode **43*a* described later, to suppress generation of electron beams by other linear cathodes 42 than the linear cathode 42 controlled to emit an electron beam for the fixed time, and to allow the electron beams generated to travel only forward. The backing electrodes 41** may be formed of a conductive material applied to an inner rear wall of the glass bulb mentioned above.

The vertically converging electrode **43*a* is in the form of a conductive plate 51 defining a plurality of horizontally elongated slits 50 opposed to the linear cathodes 42, respectively. Each of the electron beams emitted from the linear cathodes 42 proceeds through one of the slits 50** to be vertically converged.

Each slit 50 may have bars arranged at suitable intervals therealong. Alternatively, each slit 50 may be in the form of a row of through holes arranged horizontally at minute intervals (so that the holes are almost continuous with one another) to act substantially as a slit. The vertically converging electrode **43*b* is similar to this electrode 43*a***.

Each of the vertically deflecting electrodes 44 extends horizontally over a range corresponding to an intermediate portion of one slit 50. Each of the vertically deflecting electrodes 44 includes conductors **53*a* and 53*b* applied to upper and lower surfaces of an insulating substrate 52, respectively. A vertically deflecting voltage is applied between opposed conductors 53*a* and 53*b*** to deflect an electron beam vertically.

In this embodiment, a pair of conductors **53*a* and 53*b* vertically deflects an electron beam from one linear cathode 42 to positions corresponding to 16 lines. This embodiment includes 64 vertically deflecting electrodes 44 to provide 63 pairs of conductors corresponding to the 63 linear cathodes 42. Consequently, the electron beams are vertically deflected to describe 1,008 horizontal lines on the photoconductive film 25 of the target 12**.

Next, each of the electron beam flow control electrodes 45 comprises a conductive plate 55 defining a vertically elongated slit 54. The control electrodes 45 are arranged horizontally at suitable intervals. This embodiment includes 100 controlling conductive plates 55 (though, for expediency, only ten are shown in FIG. 14). The electron beam flow control electrodes 45, successively from a starting end of horizontal scanning, receive a beam selecting signal. Each flow control electrode 45 allows the electron beams to pass therethrough only during periods of beam selecting signal reception, with the other flow control electrodes 45 stopping passage of the electron beams. Each of the electron beams having successively passed through the flow control electrodes 45 is used to read signals from ten pixels arranged horizontally (i.e. an electric potential distribution on the photoconductive film 25). In this embodiment, therefore, the potential distribution on the photoconductive film 25 is read horizontally as signals from 1,000 (100×10) pixels.

The horizontally converging electrode 46 is in the form of a conductive plate 57 defining a plurality of (e.g. 100) vertically elongated slits 54 opposed to the slits 54 in the electron beam flow control electrodes 45, respectively. Each of the electron beams is horizontally converged to a thin electron beam corresponding in size to one pixel.

Each of the horizontally deflecting electrodes 47 is in the form of a conductive plate 58 extending vertically over a range corresponding to an intermediate portion of one slit 56. A horizontally deflecting voltage is applied between adjacent deflecting electrodes 47. As a result, an electron beam passing between adjacent deflecting electrodes 47 is horizontally deflected to scan horizontally a region of the photoconductive film 25 corresponding to ten pixels.

The accelerating electrodes 48 are in the form of conductive plates 59 extending horizontally in positions similar to those of the vertically deflecting electrodes 44. These accelerating electrodes 48 act to draw or attract the electron beams.

The decelerating electrode 49 is in the form of a mesh conductor 60 defining numerous pores. The decelerating electrode 49 has a function to decelerate the electron beam immediately before the photoconductive film 25 of the target 12, and direct the electron beams to enter the photoconductive film 25 at right angles thereto.

In the X-ray image pickup tube having the above construction, each electron beam enters the photoconductive film 25 of the target 12 and, under the action of the horizontally deflecting electrodes 47, horizontally scans a region of the photoconductive film 25 corresponding to ten pixels to read an electric potential distribution in that region. When the region of ten pixels has been read, the electron beam flow control electrodes 45 are switched to shift a beam path horizontally by a degree corresponding to ten pixels. As a result, the electron beam scans a next region of ten pixels to read an electric potential distribution in that region. Subsequently, the electron beam flow control electrodes 45 are switched in succession to read a whole electric potential distribution over one horizontal line on the photoconductive film 25. After the electric potential distribution over one line is read, the backing electrodes 41 and vertically converging electrodes 43*a* and 43*b* are switched, whereby an electron beam is emitted from a next lower linear cathode 42 to read an electric potential distribution over another horizontal line on the photoconductive film 25 in the manner described above. Thus, the linear cathodes 42 are selectively driven to read an electric potential distribution over an entire area of the photoconductive film 25.

The present invention may be embodied in other specific forms without departing from the spirit or essential attributes thereof and, accordingly, reference should be made to the appended claims, rather than to the foregoing specification, as indicating the scope of the invention.

What is claimed is:

1. An X-ray image pickup tube for converting a transmitted X-ray image into electric signals, comprising:

a fluorescent element for receiving transmitted X-rays in a two-dimensional distribution and converting said transmitted X-rays into visible rays in a two-dimensional distribution;

a translucent conductive film optically coupled to a surface of said fluorescent element opposite from an X-ray incident surface thereof, said translucent conductive film receiving a high voltage;

a photoconductive film laminated on said translucent conductive film and including an amorphous semiconductor layer having functions to convert said visible rays transmitted in a two-dimensional distribution through said translucent conductive film, into electric charges in a two-dimensional distribution, and to multiply said electric charges in the two-dimensional distribution based on electric fields formed by said high voltage applied to said translucent conductive film; and signal reading means for scanning a surface of said photoconductive film opposite from a visible ray incident surface thereof to read, as electric signals, a two-dimensional electric potential distribution occurring on said photoconductive film, said X-ray image pickup tube further comprising an intermediate layer disposed between said fluorescent element and said translucent conductive film, said intermediate layer having at least one smooth surface opposed to said translucent conductive film.

2. An X-ray image pickup tube as defined in claim 1, wherein said intermediate layer is a thin glass plate.

3. An X-ray image pickup tube as defined in claim 1, wherein said intermediate layer is a fiber plate including a multiplicity of optical fibers bundled and joined between peripheral surfaces.

4. An X-ray image pickup tube as defined in claim 3, wherein said fiber plate acts also as a support base for a target structure including said fluorescent element, said translucent conductive film and said photoconductive film.

5. An X-ray image pickup tube as defined in claim 3, wherein said fiber plates defines a spherically recessed surface opposed to said translucent conductive film.

6. An X-ray image pickup tube as defined in claim 1, wherein said intermediate layer is a resin layer formed on said fluorescent element.

7. An X-ray image pickup tube as defined in claim 1, wherein said intermediate layer is an SiO film formed on said fluorescent element.

8. An X-ray image pickup tube as defined in claim 1, wherein said intermediate layer is an $SiO_2$ film formed on said fluorescent element.

9. An X-ray image pickup tube for converting a transmitted X-ray image into electric signals, comprising:

a fluorescent element for receiving transmitted X-rays in a two-dimensional distribution and converting said transmitted X-rays into visible rays in a two-dimensional distribution;

a translucent conductive film optically coupled to a surface of said fluorescent element opposite from an X-ray incident surface thereof, said translucent conductive film receiving a high voltage:

a photoconductive film laminated on said translucent conductive film and including an amorphous semiconductor layer having functions to convert said visible rays transmitted in a two-dimensional distribution through said translucent conductive film, into electric charges in a two-dimensional distribution, and to multiply said electric charges in the two-dimensional distribution based on electric fields formed by said high voltage applied to said translucent conductive film; and signal reading means for scanning a surface of said photoconductive film Opposite from a visible ray incident surface thereof to read, as electric signals, a two-dimensional electric potential distribution occurring on said photoconductive film, wherein said signal reading means comprises a group of switching elements arranged two-dimensionally on said photoconductive film.

10. An X-ray image pickup tube for converting a transmitted X-ray image into electric Signals, comprising:

a fluorescent element for receiving transmitted X-rays in a two-dimensional distribution and converting said transmitted X-rays into visible rays in a two-dimensional distribution:

a translucent conductive film optically coupled to a surface of said fluorescent element opposite from an X-ray incident surface thereof, said translucent conductive film receiving a high voltage;

a photoconductive film laminated on said translucent conductive film and including an amorphous semiconductor layer having functions to convert said visible rays transmitted in a two-dimensional distribution through said translucent conductive film, into electric charges in a two-dimensional distribution, and to multiply said electric charges in the two,dimensional distribution based on electric fields formed by said high voltage applied to said translucent conductive film: and signal reading means for scanning a surface of said photoconductive film opposite from a visible ray incident surface thereof to read, as electric signals, a two-dimensional electric potential distribution occurring on said photoconductive film, wherein said signal reading means comprises an electron beam generating mechanism including:

a plurality of linear cathodes acting as electron beam sources juxtaposed opposite a surface of said fluorescent element in a target structure including said fluorescent element, said translucent conductive film and said photoconductive film;

a plurality of backing electrodes arranged rearwardly of said linear cathodes (i.e. at a side remote from said target structure) and in corresponding relations with said linear cathodes, respectively;

a plurality of vertically converging electrodes arranged forwardly of and in corresponding relations with said linear cathodes (i.e. at a side opposed to said target structure) for producing potential gradients with said backing electrodes, thereby to allow only a selected one of said linear cathodes to generate an electron beam, and to converge vertically and thrust said electron beam forward;

a plurality of vertically deflecting electrodes arranged in corresponding relations with said linear cathodes for vertically deflecting electron beams having passed through said vertically converging electrodes;

a plurality of electron beam flow control electrodes for acting on the electron beams having passed through said vertically deflecting electrodes to switch paths of said electron beam successively along a horizontal line;

a plurality of horizontally deflecting electrodes associated with said electron beam flow control electrodes for horizontally deflecting the electron beams having passed through said electron beam flow control electrodes;

a plurality of accelerating electrodes for drawing the electron beam having passed through said horizontally deflecting electrodes toward said target structure; and a decelerating electrode for decelerating the electron beam having passed through said accelerating electrodes before said target structure.

* * * * *